US009668576B2

(12) United States Patent
Trunkle

(10) Patent No.: US 9,668,576 B2
(45) Date of Patent: Jun. 6, 2017

(54) CABINET HANGING AND ALIGNING SYSTEM AND METHOD

(71) Applicant: Timothy James Trunkle, Charleston, SC (US)

(72) Inventor: Timothy James Trunkle, Charleston, SC (US)

( * ) Notice: Subject to any disclaimer, the term of this patent is extended or adjusted under 35 U.S.C. 154(b) by 26 days.

(21) Appl. No.: 14/686,450

(22) Filed: Apr. 14, 2015

(65) Prior Publication Data

US 2016/0045026 A1 Feb. 18, 2016

Related U.S. Application Data

(63) Continuation-in-part of application No. 14/458,914, filed on Aug. 13, 2014, now abandoned.

(51) Int. Cl.
*A47B 95/00* (2006.01)
*A47B 96/06* (2006.01)

(52) U.S. Cl.
CPC ..... *A47B 95/008* (2013.01); *A47B 96/06* (2013.01)

(58) Field of Classification Search
CPC ... A47B 95/002; A47B 95/008; A47B 97/001; A47B 96/006
USPC ..... 248/214, 215, 220.1, 223.31, 225.11, 248/225.21, 244, 298.1; 312/245, 247, 312/111, 198, 279, 140.1, 263, 264; 211/94, 94.01, 87, 87.01, 88, 126, 189, 211/183; 52/27, 36.4, 36.5, 506.01, 52/506.03, 235, 836
See application file for complete search history.

(56) References Cited

U.S. PATENT DOCUMENTS 2,521,134 A * 9/1950 Stanitz ..... A47B 95/008 211/72
2,708,147 A * 5/1955 Burke ..... A47B 77/04 220/3.3
3,025,122 A * 3/1962 Millman ..... A47B 95/008 220/476
3,621,635 A * 11/1971 Lange ..... E04F 13/083 29/460
3,698,565 A * 10/1972 Weber ..... A47F 5/0846 211/126.15
3,938,870 A * 2/1976 Guest ..... B42F 15/0035 24/486
3,950,049 A * 4/1976 Drass ..... A47B 95/008 312/198
4,133,507 A * 1/1979 Chervenak ..... A47B 95/008 248/223.41
4,165,852 A * 8/1979 Chervenak ..... A47B 95/008 108/152
4,329,003 A * 5/1982 Manchester ..... A47B 95/008 108/152

(Continued)

*Primary Examiner* — Muhammad Ijaz
(74) *Attorney, Agent, or Firm* — B. Craig Killough; Barnwell Whaley Patterson & Helms

(57) ABSTRACT

A wall rail system for hanging and aligning cabinets has a wall mounting rail and a cabinet mounting bracket. The wall mounting rail is mounted to a wall. The cabinet mounting bracket is mounted to an upper back portion of a cabinet. An upper portion of the cabinet mounting bracket is constructed and arranged for receiving a portion of the wall mounting rail. The upper portion of the cabinet mounting bracket is retained within the portion of the wall mounting rail, which aligns the cabinet for mounting to the wall.

9 Claims, 5 Drawing Sheets

(56) References Cited

U.S. PATENT DOCUMENTS

| | | | | | |
|---|---|---|---|---|---|
| 4,340,106 | A * | 7/1982 | Van Horn, II | E06B 3/80 | 160/184 |
| 4,342,439 | A | 8/1982 | Bruner | | |
| 4,457,436 | A * | 7/1984 | Kelley | A47B 95/008 | 211/88.01 |
| 4,750,624 | A * | 6/1988 | Baron | A47F 5/0846 | 211/189 |
| 4,928,913 | A | 5/1990 | Laughon et al. | | |
| 5,050,832 | A * | 9/1991 | Lee | A47B 95/008 | 248/222.51 |
| 5,375,723 | A * | 12/1994 | Kelley | A47B 81/00 | 211/1.3 |
| 5,624,168 | A * | 4/1997 | Licciardello, Sr. | A47B 95/008 | 211/94.01 |
| 5,718,493 | A * | 2/1998 | Nikolai | A47B 88/0014 | 312/245 |
| 6,076,904 | A * | 6/2000 | Shepherd | A47B 95/008 | 312/209 |
| 6,557,311 | B1 * | 5/2003 | Mongelli | E04F 19/0436 | 52/288.1 |
| 7,748,182 | B2 * | 7/2010 | McGee | E04B 2/7457 | 52/235 |
| 2009/0152217 | A1 * | 6/2009 | Gmerek | A47F 5/0838 | 211/27 |
| 2013/0134849 | A1 * | 5/2013 | Menzel | A47B 95/008 | 312/265.5 |
| 2013/0180202 | A1 * | 7/2013 | Woods | A47B 5/00 | 52/710 |

* cited by examiner

CABINET HANGING AND ALIGNING SYSTEM AND METHOD

This application is a continuation in part of application Ser. No. 14/458,914, filed Aug. 13, 2014.

FIELD OF THE INVENTION

This invention relates to cabinets, and is more particularly directed to a system and method for hanging and aligning wall cabinets.

BACKGROUND OF THE INVENTION

Prefabricated cabinets are the most common type of cabinets installed in homes today. Whether they are being installed by volume builders in production style homes, or by an individual homeowner performing a remodeling job, prefabricated cabinetry offers a variety of selections and affordability that has made them a popular choice.

Frequently, spacing of wall studs into which cabinets are mounted does not coincide with the manufactured hanging strips for the varying sizes of cabinets. Consequently, the recommended number of wall cabinet hanging fasteners for mounting to wall studs may not be utilized. Localized loads on the cabinet hanging framework may be in excess of recommended loading, thereby resulting in damage to the structural integrity of the cabinet, especially when the cabinet is in use as storage by the user.

Further, undulations or variations in the wall surface where the cabinets are mounted may cause the prefabricated cabinet hanging strip to become separated from the cabinet when the strip is secured to the wall. In the event that an installation fastener is improperly shimmed, the fastener may separate the hanging strip from the cabinet, especially when a fastener is placed near the center of the cabinet hanging strip.

In order to install wall cabinets in a more secure manner, the location of each wall stud of a wall on which cabinets are hung must be conformed to the hanging points of the cabinet. This process is both time consuming and tedious and does not allow for error. Cabinets are usually installed one at a time by securing the cabinet to the wall, and additional cabinets are installed next to the previously positioned cabinet unit(s). Each successive cabinet unit is attached to the wall adjacent to the previous cabinet unit, requiring alignment vertically, horizontally and across the face of the cabinet units to be maintained. Even minor variations or change in placement of the cabinets usually requires considerable additional measuring and modification.

There is a need for a device and method for hanging and aligning cabinets that installs quickly and easily, increases the strength and integrity of the cabinet unit, and can be employed on any prefabricated cabinet unit and most custom cabinets that allows for placement and alignment of wall of cabinets prior to securing the cabinets to a wall.

SUMMARY OF THE INVENTION

A wall rail system for hanging and aligning cabinets has a wall mounting rail and a cabinet mounting bracket. The wall mounting rail is mounted to a wall. The cabinet mounting bracket is mounted to an upper back portion of a cabinet. A portion of the wall mounting rail extends upwardly and outwardly from the middle portion of the wall mounting rail at an angle. An upper portion of the cabinet mounting bracket extends first outwardly from the cabinet mounting bracket and then downwardly and toward the cabinet mounting bracket to form a generally inverted channel. The inverted channel of the cabinet mounting bracket is constructed and arranged for receiving a portion of the wall mounting rail. The upper portion of the cabinet mounting bracket is retained by the wall mounting rail, which aligns the cabinet for mounting to the wall.

BRIEF DRAWING DESCRIPTION

DESCRIPTION OF PREFERRED EMBODIMENTS

Figure 1:
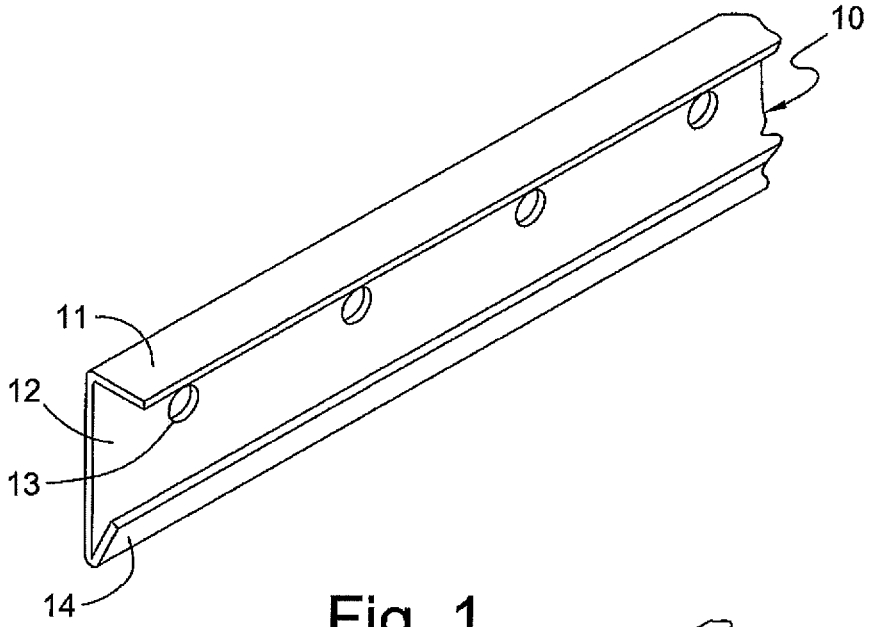
FIG. 1 depicts the wall hanging rail in isometric perspective.

FIG. 1 shows an embodiment of a wall mounting rail 10. The wall mounting rail is preferred to be an elongated and generally rigid member. The wall mounting rail as shown has an upper leg 11 that may be formed generally perpendicularly to the middle portion 12 of the wall mounting rail, and extending from the top of the middle portion. The middle portion 12 is preferred to have a plurality of holes 13 that are constructed to receive mounting fasteners. The holes 13 are spaced to permit mounting in a variety of wall stud spacings. In one embodiment, the holes 13 are spaced 0.75 inches apart along the centerline of the rail, which provides many mounting holes for adapting mounting to various wall stud configurations.

A lower portion 14 of the wall mounting rail 10 is formed to provide a channel. The channel may be formed by the lower portion extending outwardly and upwardly from a bottom of the middle portion 12, and toward an upper portion of the wall mounting rail. A V shaped or U shaped channel is formed. The lower portion 14 may join the middle portion at an angle of 15 to 75 degrees, and more preferably, at 30 to 60 degrees.

Figure 2:
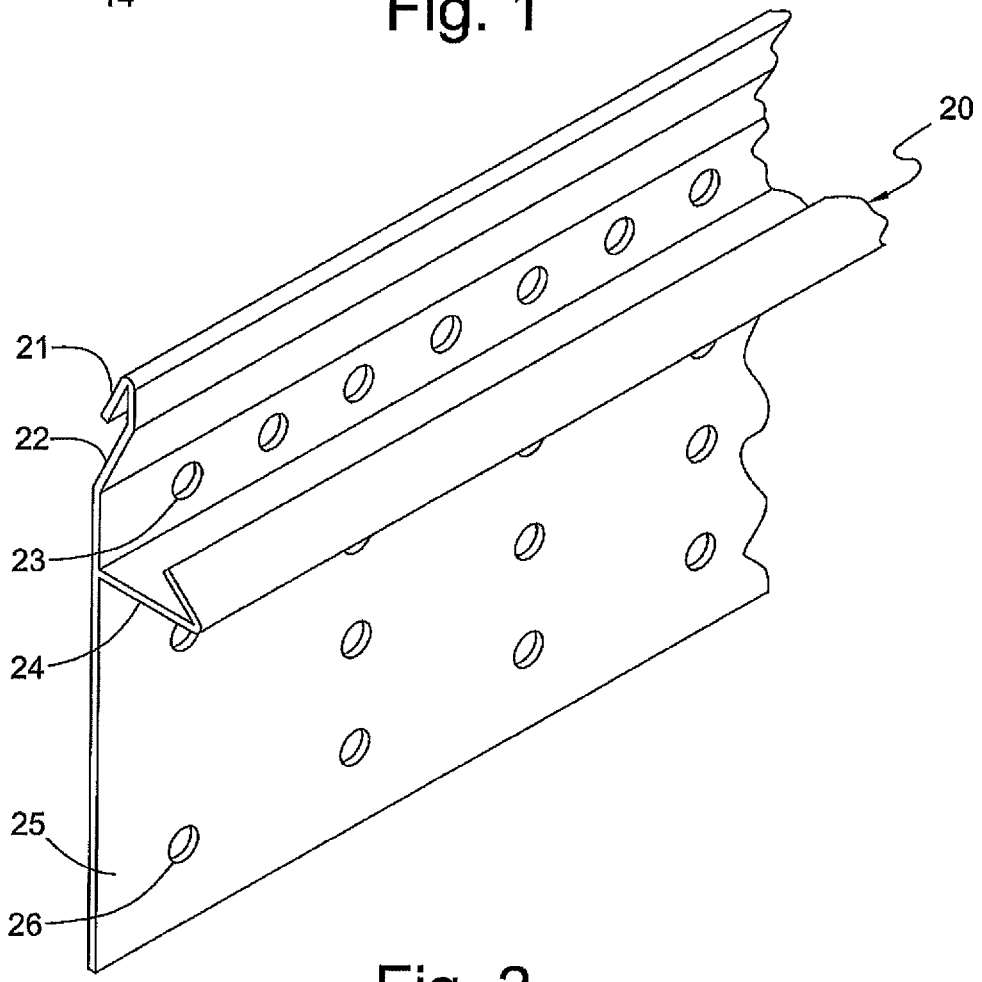
FIG. 2 depicts the cabinet bracket in isometric perspective.
Figure 3:
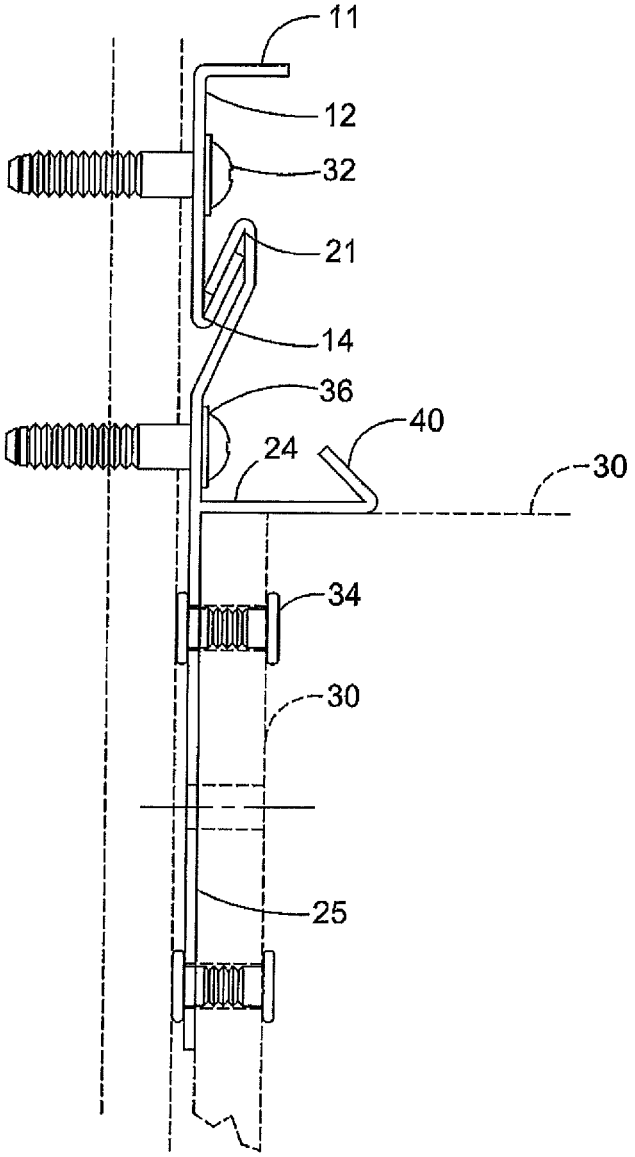
FIG. 3 depicts a side, sectioned view of the assembled wall cabinet hanging device, showing the cabinet bracket engaged in the wall rail, with a mounted cabinet top and back demonstrated as a phantom.

FIG. 2 shows a cabinet mounting bracket 20 according to an embodiment of the invention. The cabinet mounting bracket is preferred to be an elongated and generally rigid member. The cabinet mounting bracket as shown has an inverted V or U shaped channel 21 in an upper portion. The upper portion of the cabinet mounting bracket extends away from the lower portion 25 of the bracket as an offset 22, and then downwardly at an opposite end toward the lower portion to form the inverted channel. The offset allows the lower portion 25 of bracket 20 to align with middle portion 12 of the wall rail 10 when the inverted channel portion 21 is inserted into wall rail 10 lower portion 14. The angle of the inverted channel portion is preferred to be formed so that the surface of the inverted channel is against substantially the entire interior surface of the lower portion 14 as shown in FIG. 3.

The middle portion 24 in this embodiment is a leg which extends generally perpendicularly to the lower portion 25. The leg may have an upward extension 40 at or near the end thereof. The extension may form a V shaped edge, and may have a length of about 0.625 inches.

The lower portion 25 may have a plurality of mounting holes 26 that extend along the length of the bracket 20. The bottom portion may have a series of holes, such as 3 evenly spaced and vertically aligned 0.25 inch diameter holes starting at a distance of 0.5 inches below the perpendicular leg 24 extending to within 0.5 inches of the bottom of said bracket.

The wall mounting rail may be formed of metal such as steel with punched holes formed for receiving the required fasteners. The holes may be 0.025 dia. holes set on 0.75 inch centers. The rail may be formed in lengths as required, and may be formed in lengths of 8 feet, and cut to the desired length at the time of use. Multiple sections may be used as needed for length requirements.

In use, the wall mounting rail is leveled on a wall at a pre-determined height and mounted to studs, such as by screws 32. For example, #10-2½ inch pan head screws may be attached to each wall stud and shimmed as needed with metal or plastic square slotted washers. The perpendicular leg 11 adds rigidity that helps provides a straight mounting plane, and also acts as a guide or upper limit when positioning the cabinet mounting bracket 20. The wall mounting rail is attached to the wall studs, which is facilitated by the multiple mounting holes that are frequently spaced along the wall mounting rail. The wall mounting rail eliminates the need for mounting the cabinets directly in the studs during alignment, and eliminates the need for the associated precision measuring during the cabinet mounting process, while employing the wall studs to hold the cabinets in place.

The cabinet mounting bracket is mounted on the upper back of any pre-fabricated cabinet 30. Vertical alignment is provided by leg 24 that is formed at a right angle to the cabinet mounting bracket. The cabinet mounting bracket is preferred to be attached at several points across the length of the cabinet bracket. The selected attachment holes 26 in the bracket serve as drill alignment holes. Holes are drilled through the cabinet and the cabinet mounting bracket is attached to the cabinet such as with screws 34. In one embodiment, #8-32×¾ inch low profile machine screws are inserted through the drilled hole and are captured by #8-32×¾ inch Tee nuts installed on the inside of the cabinet. This structure provides holding capacity that is superior to the cabinet structure alone, and spreads the load across the entire internal hanging rail of the cabinet, thereby eliminating a tendency of the cabinet to separate at the attachment point. This separation often occurs when the cabinet is secured at too few alignment points.

After a cabinet mounting bracket is attached, the cabinet is then hung on the wall rail in its approximate pre-determined location. This step is repeated until all of the wall cabinets are in place on the wall mounting rail. After some or all of the cabinets are in place the position of the cabinets can be adjusted by moving or sliding the cabinet mounting bracket horizontally along the wall mounting rail as needed to provide for desired margins and alignment. The device allows the cabinet mounting bracket to slide relative to the wall mounting rail, permitting alignment of the cabinet while the cabinet is structurally supported by the wall.

Once final positioning of the cabinets is determined, the faces of the cabinets are secured for front plane alignment. After the cabinet faces are aligned and secured, the cabinets are permanently secured. For example, screws 36, such as #10×2½ inch pan head screws, may be installed through the cabinet mounting bracket holes 23 that may be positioned just below the inverted V portion of the cabinet mounting bracket and in line with the wall mounting rail, with a mounting screw visible just above the bracket/rail attachment point. This prevents movement of the upper portion of the wall cabinet. Holes 23 may be located at a point on the cabinet mounting bracket a distance of about 0.375 inches from the bottom of the offset.

Figure 5:
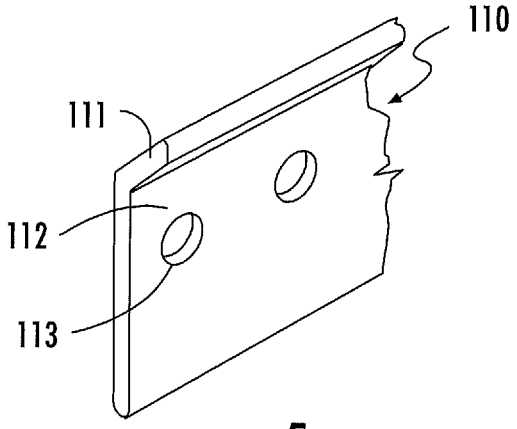
FIG. 5 depicts another embodiment of the wall hanging rail in isometric perspective.

FIG. 5 shows another embodiment of a wall mounting rail 110. The wall mounting rail is preferred to be a generally rigid member that may be elongated. The wall mounting rail as shown has an upper leg 111 extends from 15° to 75° from horizontal, and more preferably, 40° to 70° from horizontal. The upper leg may extend from the middle portion 112 of the wall mounting rail, and may extend from the top of the middle portion. The middle portion 112 is preferred to have a plurality of holes 113 that are constructed to receive mounting fasteners wherein said middle portion is defined as a generally vertical member. The holes 113 may be positioned for mounting to a variety of wall stud spacings. In one embodiment, the holes 113 are spaced 0.75 inches apart along the centerline of the rail.

Figure 6:
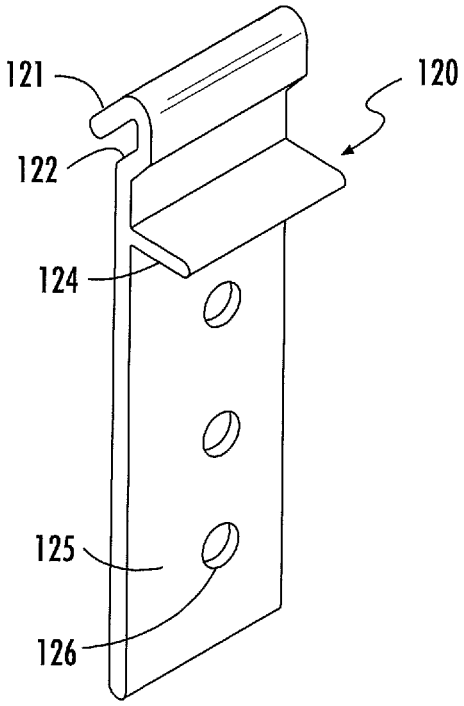
FIG. 6 depicts another embodiment the cabinet bracket in isometric perspective.
Figure 7:
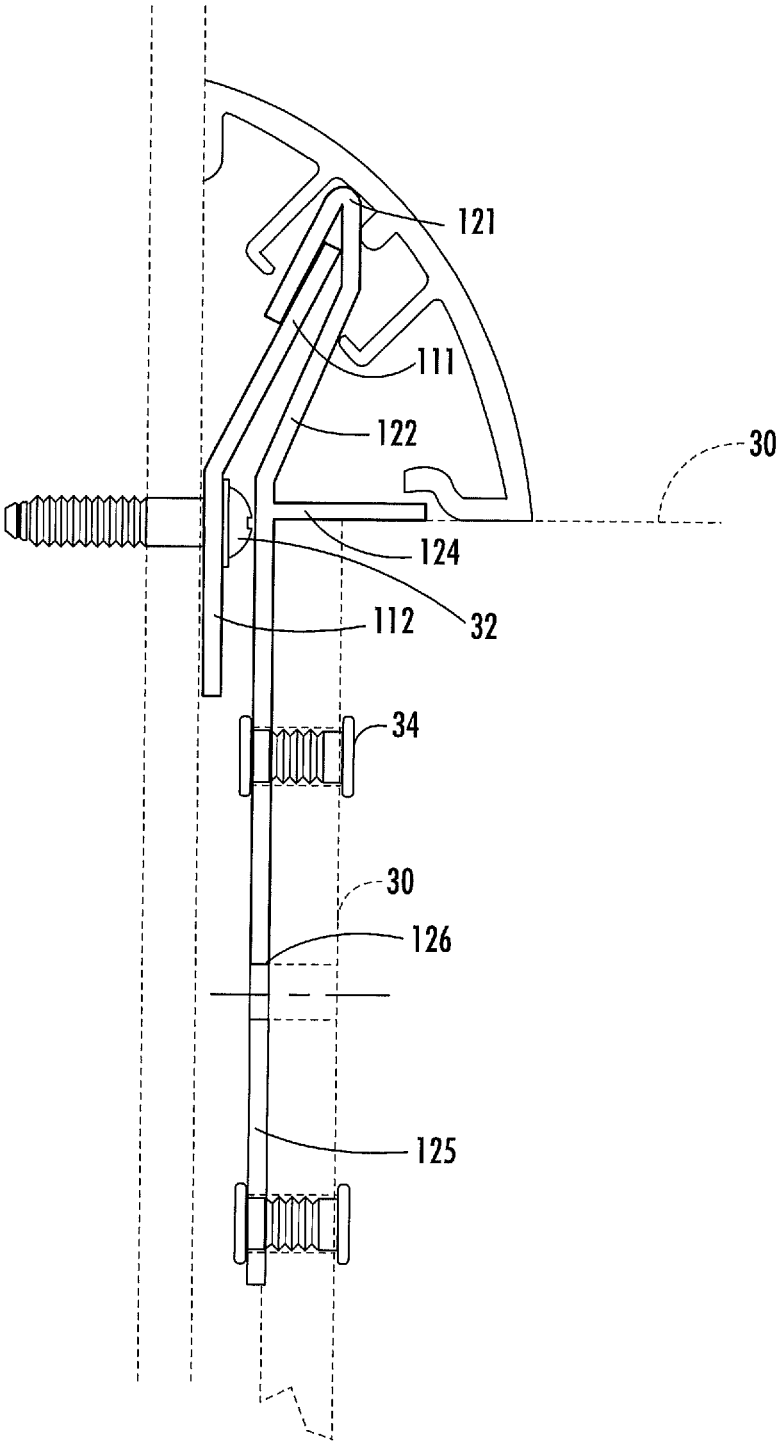
FIG. 7 depicts a side, sectioned view of the assembled wall cabinet hanging device of FIGS. 5 and 6, showing the cabinet bracket engaged in the wall rail, with a mounted cabinet top and back demonstrated as a phantom.

FIG. 6 shows a cabinet mounting bracket 120 according to another embodiment of the invention. The cabinet mounting bracket is preferred to be a generally rigid member. The cabinet mounting bracket as shown has an inverted V or U shaped channel 121 in an upper portion. The upper portion of the cabinet mounting bracket extends away from the lower portion 125 of the bracket as an offset 122, and then downwardly at an opposite end of the channel and toward the lower portion of the bracket to form the inverted channel. The offset allows the lower portion 125 of bracket 120 to align with middle portion 12, 112 of the wall rail embodiments 10,110 when the inverted channel portion 121 is inserted into wall rail 10,110 at lower portion 14 or upper leg 111. The angle of the inverted channel portion is preferred to be formed so that the lower portion 14 as shown in FIG. 3, or the upper leg 111 as shown in FIG. 7, is fully engaged to substantially the bottom of the channel of the channel portion. The middle portion 124 in the embodiment of FIG. 6 may have leg that extends generally perpendicularly to the lower portion 125.

The lower portion 125 may have a plurality of mounting holes 126 that extend along the length of the bracket 120. The bottom portion may have a series of holes, such as 3 evenly spaced and vertically aligned 0.25 inch diameter holes starting at a distance of 0.5 inches below the perpendicular leg 124 and extending to within 0.5 inches of the bottom of said bracket.

The wall mounting rail may be formed of metal, such as steel, with punched holes formed for receiving the required fasteners. The holes may be 0.025 dia. holes set on 0.75 inch centers. The rail may be formed in lengths as required, and may be formed in lengths of 8 feet, and cut to the desired length at the time of use. Multiple sections may be used as needed for length requirements.

In use, the wall mounting rail 111 is leveled on a wall at a pre-determined height and mounted to studs, such as by screws 32. For example, #10-2½ inch pan head screws may be attached to each wall stud and shimmed as needed with metal or plastic square slotted washers. The wall mounting rail is attached to the wall studs, which may be facilitated by multiple mounting holes that are spaced along the rail. The rail eliminates the need for mounting the cabinets directly in the studs during alignment, and eliminates the need for the associated precision measuring during the cabinet mounting process.

The cabinet mounting bracket may also be formed of metal, such as steel, and may be formed in lengths as required. A plurality of cabinet mounting brackets 120 are spaced apart and mounted on the upper back of any prefabricated cabinet 30. The number and spacing of the mounting brackets is chosen according the length and weight of the cabinet. By way of example, a cabinet mounting bracket 120 will be positioned near each opposite end and on the back of the cabinet, with an additional cabinet mounting brackets spaced apart at about 16 inches. Vertical alignment is improved by leg 124 that is formed at a about a right angle to the cabinet mounting bracket. Holes are drilled through the cabinet and the cabinet mounting brackets are attached to the cabinet such as with screws 34. In one embodiment, #8-32×¾ inch low profile machine screws are inserted through the drilled hole and are captured by #8-32×¾ inch Tee nuts installed on the inside of the cabinet. This structure provides holding capacity that is superior to the cabinet structure alone, and spreads the load across multiple hanging cabinet mounting rails, thereby helping to eliminate a tendency of the cabinet to separate at the attachment point. This separation often occurs when the cabinet is secured at too few points.

Figure 4:
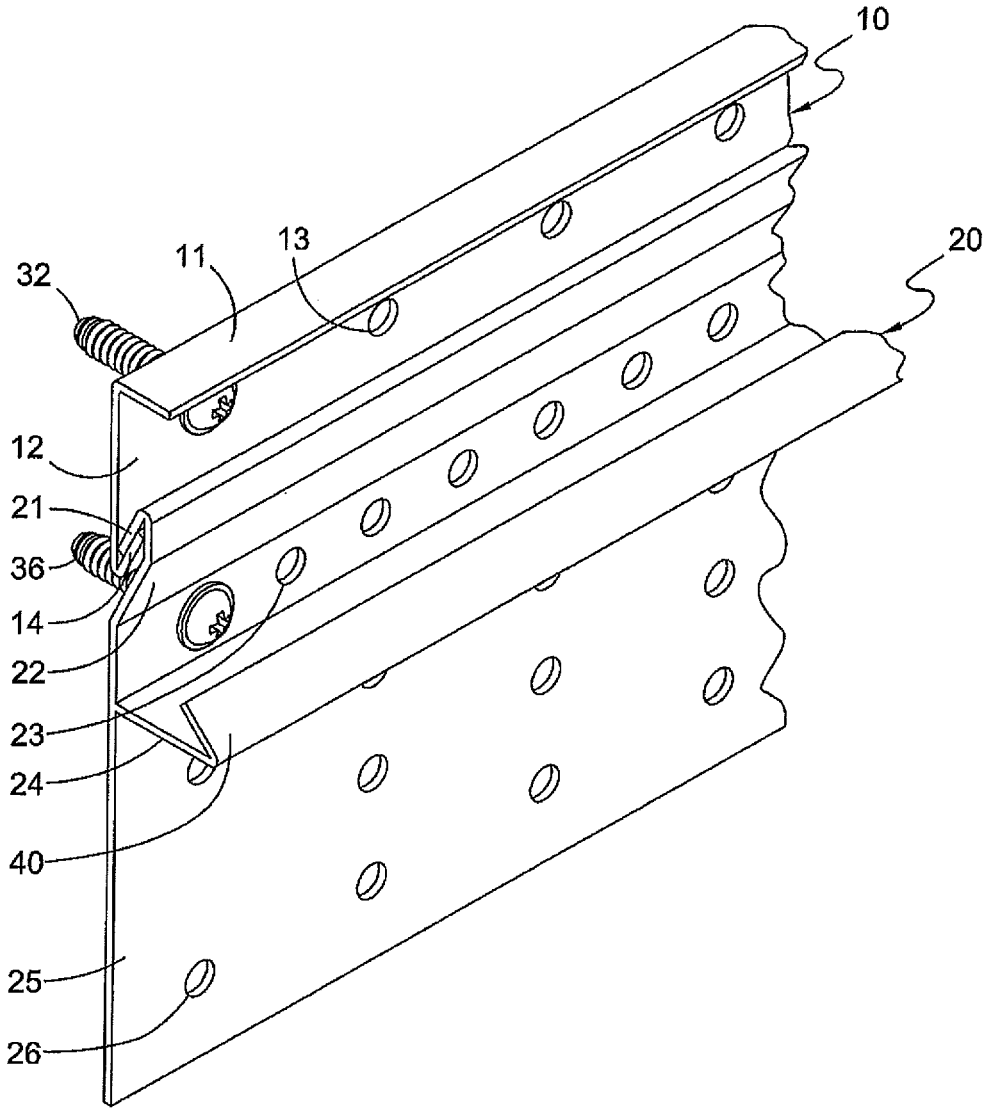
FIG. 4 depicts a perspective view demonstrating the assembled wall cabinet hanging device of FIG. 3.

After cabinet mounting brackets are attached, the cabinet is then hung on the wall rail in its approximate pre-determined location. This step is repeated until all of the wall cabinets are in place on the wall rail. As with the embodiment of FIG. 4, after some or all of the cabinets are in place they can be adjusted by moving or sliding the cabinet mounting bracket horizontally along the wall mounting rail as needed to provide for desired margins and alignment. Alignment of the cabinets may be performed while the cabinet is supported by the wall through the use of the invention.

Fasteners are installed through each cabinet's lower internal hanging strip as per the cabinet manufacturer's recommendations. The fasteners are installed at wall stud positions previously located when installing the wall mounting rail.

A decorative cap may be placed over the cabinet mounting bracket 120 and wall mounting bracket 111 construct. The decorative cap may be formed as a quarter round that spans the space between the cabinet top and the wall. The cap may be formed with gripping members that grip the wall mounting bracket.

This invention provides a wall cabinet hanging and alignment system that eliminates many problems associated with cabinet alignment and hanging. This novel hanging system 1) speeds installation time by eliminating the majority of the typical calculating and measurement transfers associated with cabinet installation; 2) increases the structural integrity of the cabinets; 3) allows for alignment adjustments prior to final attachment; and 4) is universally adaptable for use on any standard manufactured wall cabinet. The wall rail provides a permanent horizontal alignment along a wall, while the unique cabinet bracket, by design, automatically ensures vertical alignment and strengthens the integrity of any cabinet mounted on the rail.

What is claimed:

1. A system for hanging and aligning a cabinet on a vertical wall comprising:

(a) a cabinet having a back wall and a top plane, wherein the back wall and the top plane meet at generally a right angle to form an exterior corner of the cabinet;

(b) a wall mounting rail, the wall mounting rail comprising a generally vertical member and a leg that extends outwardly from the generally vertical member, wherein, in a mounted configuration, the leg extends toward the cabinet and above a top of the back wall of the cabinet; and (c) a cabinet mounting bracket constructed and arranged to mount to the cabinet and constructed and arranged to receive the leg of the wall mounting rail therein, the cabinet mounting bracket comprising a generally vertical lower member and a generally horizontal middle member, wherein the generally horizontal middle member meets the generally vertical lower member to form an interior angle that is generally a right angle, wherein the cabinet mounting bracket is mounted to the cabinet so that the exterior corner of the cabinet contacts the cabinet mounting bracket, with the generally horizontal middle member contacting the top plane of the cabinet and the generally vertical lower member contacting the back wall of the cabinet, the cabinet mounting bracket further comprising an offset member that, in the mounted configuration, extends above the top of the back wall of the cabinet, the offset member being positioned between the generally vertical lower member and a first receiving channel that is constructed and arranged to receive the leg of the wall mounting rail within the receiving channel, and in the mounted configuration, the leg of the wall mounting rail is positioned within the receiving channel.

2. The system for hanging and aligning the cabinet on the vertical wall as described in claim 1, comprising a second cabinet mounting bracket constructed and arranged to mount to the cabinet and constructed and arranged to receive the leg of the wall mounting rail therein, the second cabinet mounting bracket comprising a generally vertical lower member and a generally horizontal middle member, wherein the generally horizontal middle member of the second cabinet mounting bracket meets the generally vertical lower member of the second cabinet mounting bracket to form an interior angle that is generally a right angle, wherein the second cabinet mounting bracket is mounted to the cabinet and spaced apart from the cabinet mounting bracket so that the exterior corner of the cabinet contacts the second cabinet mounting bracket, with the generally horizontal middle member of the second cabinet mounting bracket being generally contacting the top plane of the cabinet and the generally vertical lower member of the second cabinet mounting bracket contacting the back wall of the cabinet, the second cabinet mounting bracket further comprising an offset member that, in the mounted configuration, extends above the top of the back wall of the cabinet, the offset member of the second cabinet mounting bracket being positioned between the generally vertical lower member of the second cabinet mounting bracket and a receiving channel of the second cabinet mounting bracket that is constructed and arranged to receive the leg of the wall mounting rail within the receiving channel of the second cabinet mounting bracket, and in the mounted configuration, the leg of the wall mounting rail is positioned within the receiving channel of the second cabinet mounting bracket.

3. The system for hanging and aligning the cabinet on the vertical wall as described in claim 1, wherein a plurality of spaced apart fastener receiving holes are formed in the generally vertical member.

4. The system for hanging and aligning the cabinet on the vertical wall as described in claim 1, wherein the wall mounting rail is a rigid member and the cabinet mounting bracket is a rigid member.

5. The system for hanging and aligning the cabinet on the vertical wall as described in claim 1, wherein an opening of the channel of the cabinet mounting bracket is below a top of the channel.

6. The system for hanging and aligning the cabinet on vertical wall as described in claim 1, wherein the leg of the wall mounting rail extends outwardly from the generally vertical member at an angle of 40 degrees to 70 degrees from horizontal, and the channel is constructed and arranged to receive the leg between two sides of the channel.

7. The system for hanging and aligning the cabinet on the vertical wall as described in claim 1, wherein the leg extends above the wall mounting rail.

8. The system for hanging and aligning the cabinet on the vertical wall as described in claim 1, further comprising a decorative cap formed as a quarter round and positioned over the cabinet mounting bracket wherein, in the mounted configuration, the decorative cap is positioned over a space between the back wall of the cabinet top and the generally vertical member of the wall mounting rail.

9. The system for hanging and aligning the cabinet on the vertical wall as described in claim 1, wherein the cabinet mounting bracket has a plurality of holes formed therein, wherein the plurality of holes are in a generally vertical and spaced apart relationship.

* * * * *